US005497831A

United States Patent [19]

Hainey et al.

[11] Patent Number: 5,497,831

[45] Date of Patent: Mar. 12, 1996

[54] HYDRAULIC FRACTURING FROM DEVIATED WELLS

[75] Inventors: Bryant W. Hainey, Richardson; Xiaowei Weng, Plano, both of Tex.

[73] Assignee: Atlantic Richfield Company, Los Angeles, Calif.

[21] Appl. No.: 316,985

[22] Filed: Oct. 3, 1994

[51] Int. Cl.[6] ..... E21B 43/26

[52] U.S. Cl. ..... 166/308

[58] Field of Search ..... 166/271, 280, 166/308

[56] References Cited

U.S. PATENT DOCUMENTS

| | | | |
|---|---|---|---|
| 4,848,461 | 7/1989 | Lee | 166/308 X |
| 4,911,241 | 3/1990 | Williamson et al. | 166/308 |
| 5,074,359 | 12/1991 | Schmidt | 166/280 |
| 5,080,171 | 1/1992 | Wolf et al. | 166/308 X |

OTHER PUBLICATIONS

"Fracture Initiation and Propagation From Deviated Wellbores", X. Weng, SPE 26597, Houston, TX, 3–6 Oct., 1993.

*Primary Examiner*—William P. Neuder
*Attorney, Agent, or Firm*—Michael E. Martin

[57] ABSTRACT

Deviated wells, in particular, are hydraulically fractured at reduced rates and with higher viscosity fracturing fluids if the fracture design indicates during an initial test fracture that the instantaneous shut-in pressure, upon cessation of injection, exceeds a predetermined amount indicating high friction pressure losses in the near wellbore region of the fracture. Increasing the fracture fluid viscosity and reducing the fracture fluid rate of injection minimizes the creation of multiple fractures of reduced width in the near wellbore region and the high probability of fracture screenout resulting from the creation of the multiple reduced width fractures.

6 Claims, 2 Drawing Sheets

HYDRAULIC FRACTURING FROM DEVIATED WELLS

BACKGROUND OF THE INVENTION

1. Field of the Invention

The present invention pertains to a method for hydraulic fracturing an earth formation from a deviated well by injecting a fluid having a relatively high viscosity at a relatively low injection rate to minimize the creation of multiple-fractures and near wellbore excess friction pressure losses.

2. Background

U.S. Pat. No. 5,074,359 issued Dec. 24, 1991 to Joseph H. Schmidt and assigned to the assignee of the present invention describes a hydraulic fracturing method for earth formations which are penetrated by inclined wellbores wherein the cased wellbore is perforated at the point of maximum tensile stress in the earth formation resulting from fracture initiation. The subject matter of U.S. Pat. No. 5,074,359 is incorporated herein by reference.

Although the '359 Patent describes a method for locating perforations in well casing at the best orientation for initiating a hydraulic fracture in the expected fracture propagation plane (i.e. a plane normal to the minimum in situ horizontal stress in the formation), a substantial amount of twisting or turning of the fracture or the initiation of multiple fractures may still exist in severely misoriented wellbores which, in turn, creates near-wellbore restrictions to the flow of fracturing fluids. A relatively unrestricted flow of fracturing fluid is usually necessary to create the fracture and carry a suitable amount proppant into the fracture so that suitable production of formation fluids through the fracture and into the well may eventually result. In many cases, a phenomenon known in the art as "screenout" results when the fracture proppant prematurely bridges the entrance region of the fracture due to twisting, turning or multiple fracture thereby causing the fluid injection pressure to rise rapidly and eventually exceed the pump or wellbore tubing pressure limits.

Conventional fracture designs focus on the creation of a fracture of desirable length, height and width. It is also desirable to increase fluid efficiency to reduce the amount of fluid to be used and to minimize damage to the proppant pack in the fracture. Such considerations typically lead to a fracture design using a reasonably high pump rate, if permissible, and as low a viscosity of the fracturing fluid as possible, bearing in mind viscosity requirement for the desired fracture size. However, relatively high, near wellbore friction pressure losses have been frequently observed in conventional fracture treatments of deviated wells. This friction pressure loss is indicative of a fracture with restriction in the near wellbore region which can be substantially detrimental to the success of the fracture treatment.

In fact, the relatively high pump rate fracture treatments in accordance with conventional design practices can result in the creation of multiple fractures in deviated wells. These multiple fractures are not desired because they result in near-wellbore restrictions which prevent the propagation of a fracture of substantial length and width so that a suitable proppant pack can be introduced into this fracture and the resultant flow of production fluids into the well will provide greater productivity. Contrary to conventional practice in the art of hydraulic fracturing of deviated wells, the present invention contemplates an improved method for hydraulically fracturing earth formations from deviated wells.

SUMMARY OF THE INVENTION

The present invention provides an improved method for hydraulically fracturing an earth formation which avoids premature proppant screenout of the fracture, particularly, in deviated and substantially horizontal wells.

In accordance with an important aspect of the present invention, a well fracturing method is carried out wherein the viscosity of the fracturing fluid is increased to a value substantially greater than conventional fracturing fluid viscosity values and the fracture fluid injection or pump rate is reduced below what is normally considered desirable for initiating and propagating conventional fractures in earth formations.

In accordance with an important aspect of the present invention, the viscosity of the fracturing fluid is increased at least two-fold from that which would normally be considered for use in a fracture treatment in accordance with known relationships between viscosity, fracture width, and fracture length, and taking into consideration the available pump power and pressure losses which would be expected. In accordance with another important aspect of the present invention, pump rates or fluid injection rates are reduced as much as one-half to one-third of that normally expected or desired for inducing a suitable hydraulic fracture (i.e. from about 25% to about 75% of conventional fracturing rates).

The method of the invention contemplates injecting a relatively viscous fracture fluid at a relatively low injection rate with a view to remediating or preventing the generation of near wellbore restrictions and premature fracture screenouts. The damaging effects of a near-wellbore screenout are significantly greater than any potential damage to the formation which may be caused by higher concentrations of viscosity creating additives in the fracture fluid. Moreover, costs associated with complete failure of a hydraulic fracture treatment process far outweigh the relatively minor increase in the cost of fluids with greater amounts of viscosity increasing additives.

The method of the invention also contemplates the identification of a fracture which may prematurely screen out by conducting a preliminary injection using a fracture fluid without proppant therein and determining the instantaneous reduction in fluid pressure upon cessation of pumping of fluid into the formation.

Those skilled in the art will further appreciate the above-mentioned advantages and features of the invention, together with other superior aspects thereof upon reading the description which follows in conjunction with the drawing.

DESCRIPTION OF PREFERRED EMBODIMENTS

Figure 1:
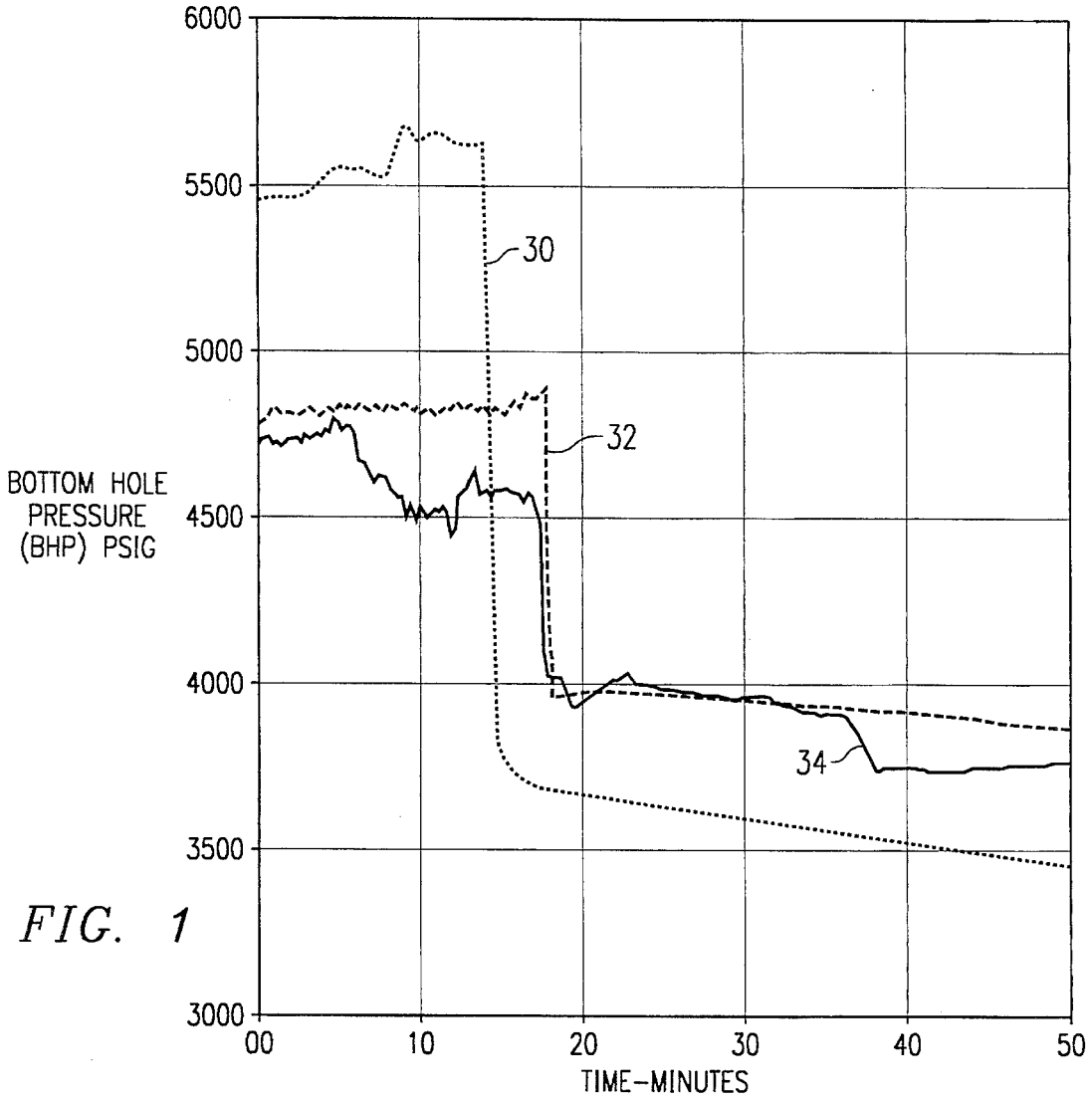
FIG. 1 is a diagram showing the change in bottomhole pressure at the cessation of pumping for different injection rates in accordance with the invention.

It has been well established that hydraulic fractures in earth formations emanating from a wellbore will form generally opposed fracture wings which extend along and lie in a plane which is normal to the minimum in situ horizontal stress in the formation zone being fractured. Ideally, the fractures form as somewhat identical opposed "wings" extending from a wellbore which has been perforated in several directions with respect to the wellbore axis. This classic fracture configuration holds generally for formations which have been penetrated by a substantially vertical well and for formations which exhibit a minimum and maximum horizontal stress distribution which intersect at an angle of approximately 90°. However, many wells are drilled at an angle to the vertical, either intentionally or as a result of deviation of the drill pipe so that the wellbore does not lie in a plane normal to the minimum horizontal stress. Accordingly, fractures formed at the wellbore have to reorient such that the fracture face is perpendicular to the minimum stress. Still further, some wellbores which are severely deviated from the vertical can generate multiple fractures.

It has been observed that so called starter fractures initiating from different perforations in a deviated well can link up to form a single fracture at the wellbore if the wellbore is not severely deviated. Otherwise, these fractures may not connect together at the wellbore. Therefore, there may exist a near-wellbore region of unconnected multiple fractures.

The existence of multiple fractures may cause severe fracture width restriction and friction pressure losses as the fracture fluid is attempted to be pumped into the formation to create the desired fracture configuration. To minimize the fracture width reduction caused by multiple fractures it is, of course, necessary to minimize the number of fractures. A publication entitled, "Fracture Initiation and Propagation From Deviated Wellbores" by Xiaowei Weng, Society of Petroleum Engineers, Richardson, Texas (SPE No. 26597) describes analytical studies of hydraulic fracture initiation and propagation from deviated wellbores. Although methods are presented in this publication for determining fracture geometry when parameters such as the stress distribution, rock properties and selected values for fracturing fluid properties are known, some uncertainties exist with respect to determining in an actual hydraulic fracturing operation whether or not multiple fractures are being created from a deviated well or if a turned and twisted two-winged fracture is being extended from the wellbore. However, with the discovery of the present invention it has been determined that hydraulic fracture treatments may be carried out from deviated wellbores, in particular, to create fractures of significant width which are suitably propped and which will result in enhanced fluid production from the fractured formation zone.

Accepted models for fracture geometry take into account the affect of fracture fluid injection rate and fluid viscosity on such parameters as fracture length (L) and fracture width (W). Accepted equations for illustrating fracture length and width are as follows:

$$L = C_1 \left[ \frac{2E' \times V_f^4}{h_f^4} \right]^{1/5} \left( \frac{1}{q_o \mu} \right)^{1/5} \quad (1)$$

$$W = C_2 \left[ \frac{V_f}{2E' h_f} \right]^{1/5} (q_o \mu)^{1/5} \quad (2)$$

Wherein $C_1$ and $C_2$ are constants based on expected fracture geometry, $V_f$ is estimated fracture volume, $h_f$ is estimated fracture height, E' is the modulus of elasticity of the rock formation being fractured, $q_o$ is volumetric injection rate of the fracturing fluid into the fracture, and $\mu$ is the viscosity of the fracturing fluid.

Conventional practice requires that the viscosity, $\mu$, be only that required to create sufficient width and to carry the proppant into the fracture without adverse settling or falling out of suspension of the proppant material in the fracturing fluid. Moreover, the viscosifiers normally added to fracture fluids are relatively expensive so for economic reasons, viscosities are normally held to the minimum amount required for proper proppant transport. Accordingly, it is standard procedure in known fracturing operations of this type, in order to achieve suitable fracture width, the minimal viscosity value is made up by increasing the fluid injection rate, $q_o$. Another factor arguing in favor of increasing injection rate is to compensate for the degradation of viscosifiers, with time, at elevated temperatures normally encountered in many formation fracturing operations. Since conventional polymer type viscosifiers suffer thermal degradation when exposed to the elevated temperatures of many subterranean formations, it is desirable to increase the pump rate to place as much proppant in the fracture as possible before reduced viscosity adversely affects proppant transport and a reduction in fracture width, W.

However, prior to discovery of the present invention the method of fracturing deviated wells, wherein the fracture fluid injection rate was set at as high a level as possible, resulted in excessive "bottomhole" pressures and premature blockage or screenout of the fracture in the near wellbore region due to proppant bridging over the reduced width multiple fractures which were created as a result of the high pressure and high injection rate of fracturing fluids.

Figure 2:
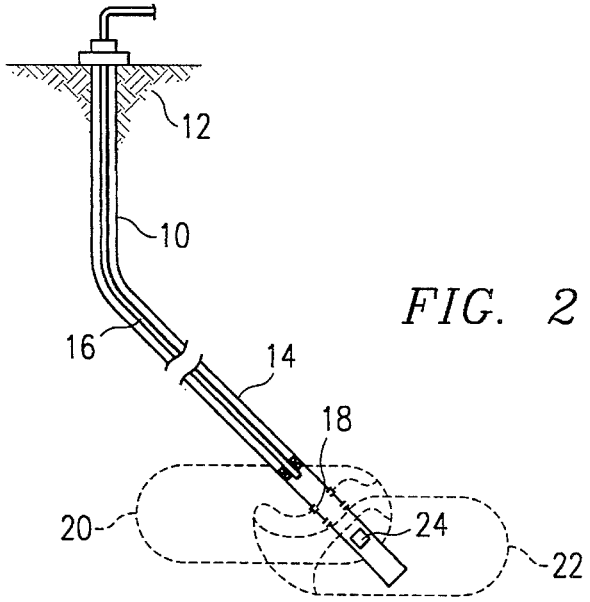
FIG. 2 is a schematic diagram of a deviated well operable to be treated to create suitable hydraulic fractures in accordance with the invention.

Referring briefly to FIG. 2, there is illustrated a typical deviated well 10 shown penetrating an earth formation 12 and having a generally deviated angular well portion 14 which intersects a zone of interest at an angle with respect to a plane normal to the minimum in situ horizontal stress. The well 10 includes a conventional tubing string 16 for injecting fluids into the formation zone through suitable perforations 18 to form multiple fracture wings 20 and 22 which extend away from the perforations 18. The well 10 is operable to have the tubing string 16 placed in communication with a source of fracturing fluid, not shown, in a conventional manner. Suitable pressure sensing means 24 is preferably disposed in the wellbore in the vicinity of the perforations 18 for recording and/or transmitting fluid pressure conditions in the vicinity of the perforations 18 to the surface for monitoring by operating personnel.

FIG. 1 shows representative traces of the pressure sensed by the pressure sensing means 24 as a function of time. The dotted line curve 30 in FIG. 1 represents the pressure as a function of time for the injection of a fracture fluid having a predetermined viscosity and injection rate in accordance with conventional practice when the fracture length and width have been predetermined in accordance with equations (1) and (2). The steep drop in the bottomhole pressure, upon cessation of pumping, which occurred at approximately 14 minutes from time 0 (the elapsed time is arbitrary and the scale is for comparison of pressure drops primarily) from about 5700 psi to 3700 psi, substantially instantaneously, indicates a significant restriction to flow of fluid into the formation in the near wellbore region and a substantial amount of friction pressure loss as a result of creating multiple narrow width fractures. By way of example the test well which was being fractured to generate the curve 30 was being subjected to an injection rate of 20.0 barrels per minute (42 U.S. gallons per barrel) of fracturing fluid comprising 40 lbs. of guar viscosifier per 1000 gallons of water having 2% potassium chloride content. The guar gel was cross-linked with a borate salt and the fluid was proppant free. This fluid has a viscosity of 325 centipoise at 175° F. The subsequent fracture treatment at this rate and fluid viscosity resulted in a premature screenout.

As a result of this screenout, an effort was made to reduce friction pressure by increasing the viscosity of the fracturing fluid to approximately 950 centipoise at a shear rate of 170 1/sec and a temperature of 175° F. by increasing the concentration of the guar gel to 50 lbs. per 1000 gallons of fracturing fluid, again with no proppant in the fluid. The injection of this higher viscosity fluid at a rate of 15.0 barrels per minute in the same well produced curve 32 which showed an instantaneous pressure drop, upon cessation of pumping, from approximately 4850 psi to 3950 psi at the pressure sensing means 24. Accordingly, a substantially higher viscosity fracturing fluid (essentially 290% greater viscosity) injected at a rate of 75% of the injection rate of the lower viscosity fluid resulted in a substantial reduction in the friction pressure loss in the near wellbore region from about 2000 psig to about 900 psig.

Finally, a second fracture treatment was carried out on the same well using the higher viscosity (950 centipoise at 170 1/sec and 175° F.) fracturing fluid injected at a rate of 8.0 barrels per minute and the pressure time curve 34 developed indicating an instantaneous pressure decrease upon cessation of pumping from 4600 psi to only 3900 psi indicating a much lower friction loss in the near wellbore region. Accordingly, at an injection rate of only 40% of fracture design injection rate and at a viscosity of 290% of fracture design viscosity, the friction pressure loss in the near wellbore region was substantially reduced and the fracture treatment was successfully pumped to completion.

Figure 3:
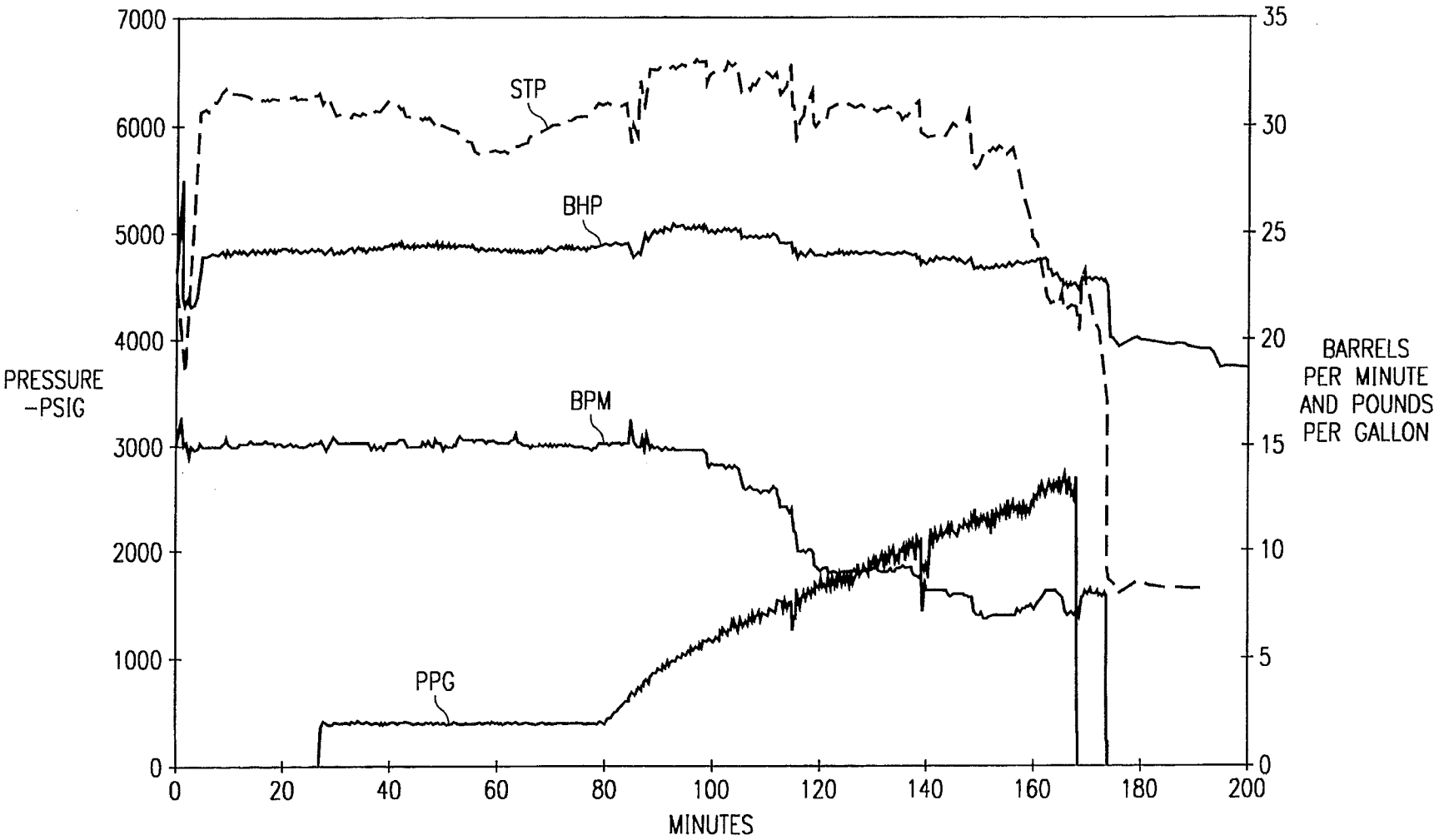
FIG. 3 is a diagram showing certain parameters as a function of time for a deviated well hydraulically fractured in accordance with the method of the invention.

FIG. 3 illustrates the parameters of surface injection fluid pressure (STP), bottom hole pressure (BHP), fracturing fluid injection rate in barrels per minute (PBM) and proppant concentration in lbs. per gallon (PPG) as a function of time for a deviated well such as the well 10 treated in accordance with the method of the present invention. The fracturing fluid was treated with 50 lbs./1000 gallons of guar gel cross-linked with a borate salt in a solution of 2% potassium chloride and water. This fracturing fluid provided a viscosity of 950 centipoise at 170 1/sec and 175° F. As will be noted from the diagram of FIG. 3 a substantially constant bottom hole pressure of approximately 4800 psig was sustained for approximately two hours and fifty minutes until the treatment was completed wherein the instantaneous shut-in pressure dropped to only 3900 psig indicating very little near wellbore friction loss during the fracture treatment. Proppant concentration was progressively increased during the final one hour and thirty minutes of injection indicating no tendency for screenout of the fracture to occur.

It has been determined in accordance with the present invention that by carrying out the method of testing a formation to be fractured by determining the near wellbore friction pressure loss through selective injection of fluids of different viscosities and at different flow rates and by selecting a viscosity-flow rate combination which will produce less than approximately 1000 psi of instantaneous fluid pressure drop, upon cessation of injection, (sometimes known as the instantaneous shut-in pressure) that an improved hydraulic fracture can be formed at selected viscosity and fluid injection rates.

The present invention contemplates that an improved hydraulic fracturing technique may be used for deviated well which intersect in a plane in an earth formation normal to the minimum in situ horizontal stress, as well as other wells which may tend to create multiple hydraulic fractures in the near wellbore region as a result of the injection of fracturing fluids through the well and into a selected earth formation. Although an exemplary fracturing treatment has been described in detail herein and a preferred embodiment of the method described, also in detail herein, those skilled in the art will recognize that various substitutions and modifications may be made to the method of the invention without departing from the scope and spirit of the appended claims.

What is claimed is:

1. A method of hydraulically fracturing an earth formation from a well penetrating said formation to minimize the creation of multiple fractures in the near-wellbore region of said formation, comprising steps of:

initially injecting a fracturing fluid into said formation through said well at a predetermined rate, said fluid being of a predetermined viscosity;

measuring the instantaneous pressure reduction in said well in the vicinity of said fractures resulting from substantial cessation of injection of said fluid into said formation; and continuing the injection of fracturing fluid at an reduced rate and a higher fluid viscosity if the near-wellbore friction pressure loss of the fluid being injected as determined from said measurements of pressure reduction is greater than about 1000 psi.

2. The method set forth in claim 1 wherein:

the injection rate of said fluid is reduced about 25% from said initial rate of injection.

3. The method set forth in claim 1 wherein:

the viscosity of said fluid is increased not less than 100% if the instantaneous pressure drop resulting from cessation of said initial injection is greater than about 1000 psig.

4. A method of hyraulically fracturing an earth formation from a well penetrating said formation to minimize the creation of multiple, minimal width fractures in the near-wellbore region of said formation, comprising steps of:

selecting a fracture length and fracture width based on the assumption that said fracture will comprise a substantially two-wing vertically extending fracture in said formation and based on a viscosity of said fracture fluid which is sufficient to create adequate facture width and to transport fracture proppant into said fracture;

determining a fracture fluid injection rate sufficient to generate said fracture of said selected width;

injecting a quantity of said fracture fluid of predetermined viscosity and at said predetermined rate initially, without fracture proppant therein;

ceasing the injection of said fracture fluid and measuring the instantaneous pressure decrease in said well in the vicinity of said fractures resulting from said cessation of said injection; and resuming the injection of fracture fluid at a reduce rate from said initial rate of injection, said fracture fluid being of a viscosity higher than the viscosity of the fracture fluid during said initial injection if the instanteous pressure drop is greater than about 1000 psi.

5. A method of hydraulically fracturing an earth formation from a well penetrating said formation to minimize the creation of multiple fractures in the near-wellbore region of said formation comprising steps of:

injecting an initial fracturing fluid having an initial, predetermined viscosity and at an initial predetermined rate until the bottomhole pressure in the well indicates a screenout has occurred within the wellbore, wherein said initial predetermined viscosity and said initial, predetermined rate being based on known fracturing relationships; and injecting a modified fracturing fluid having a fluid viscosity substantially greater than said initial viscosity and at an adjusted rate substantially less than the initial injection rate.

6. The methods set forth in claim 5 wherein:

the injection rate of said fluid is reduced from about 25% to about 75% from said initial rate of injection.

* * * * *